United States Patent [19]
Tabuchi et al.
[11] 4,452,173
[45] Jun. 5, 1984

[54] MAGNETIC BRUSH DEVELOPING APPARATUS

[75] Inventors: Kenji Tabuchi; Tateki Oka, both of Toyokawa, Japan

[73] Assignee: Minolta Camera Kabushiki Kaisha, Osaka, Japan

[21] Appl. No.: 413,435

[22] Filed: Aug. 31, 1982

[30] Foreign Application Priority Data

Sep. 4, 1981 [JP] Japan ..... 56-140066

[51] Int. Cl.³ ..... G03G 15/09; G03G 21/00

[52] U.S. Cl. ..... 118/652; 118/657; 222/DIG. 1; 355/3 DD

[58] Field of Search ..... 118/657, 652; 355/3 DD; 430/122; 222/DIG. 1

[56] References Cited

U.S. PATENT DOCUMENTS 4,161,923 7/1979 Abbott et al. ..... 118/658
4,235,194 11/1980 Wada et al. ..... 118/657
4,267,248 5/1981 Yamashita et al. ..... 430/122

FOREIGN PATENT DOCUMENTS 54-116238 9/1979 Japan .

*Primary Examiner*—Evan K. Lawrence
*Attorney, Agent, or Firm*—Wenderoth, Lind & Ponack

[57] ABSTRACT

A magnetic brush developing apparatus includes a material transport guide member extending from a developing material supply position to a developing region, in addition to a rotatable developing sleeve having an inwardly disposed rotatable manetic roller driven for rotation in the same direction as the sleeve. A clearance is maintained between the guide member and the outer peripheral surface of the developing sleeve to allow transport by the rotation of the magnetic roller of developing material, having magnetic carrier particles and electrically insulative toner particles, from the developing material supply position along the outer surface of the guide member to the developing region in a direction opposite to the direction of rotation of the magnetic roller and developing sleeve. Part of the used developing material is moved in a direction opposite to the direction of transportation of the supplied developing material through the clearance between the developing sleeve and the guide member by the rotation of the developing sleeve, so that undesirable exchanging between the fresh developing material and the used developing material is substantially prevented by the guide member.

5 Claims, 2 Drawing Figures

MAGNETIC BRUSH DEVELOPING APPARATUS

BACKGROUND OF THE INVENTION

The present invention generally relates to electrography and more particularly, to a magnetic brush developing apparatus for use in an electrographic copying machine and the like.

Recently, as one form of the magnetic brush developing apparatus of the above described type, there has been put into practical use an arrangement which includes a developing sleeve confronting a surface of an electrostatic latent image support member and driven for rotation in a direction opposite to the direction of transportation of a developing material, and a magnetic roller rotatably provided within said developing sleeve and driven for rotation at high speed in the same direction as the direction of rotation of said developing sleeve for forming a magnetic brush by magnetically attracting the developing material onto the outer peripheral surface of the developing sleeve through the magnetic force of the magnetic roller, and the magnetic brush thus formed is transported in a direction opposite to said rotating direction, by the rotation of the magnetic roller so as to be brought into rubbing contact with the surface of the electrostatic latent image support member for developing the electrostatic latent image formed thereon.

In the above case, although the developing material is transported, on the whole, in the direction as described above, part of the developing material in the vicinity of the tip portion of the magnetic brush is displaced in a direction opposite to the direction of rotation of the developing sleeve through magnetic action based on the rotation of the magnetic roller, while part of the developing material close to the root portion of the magnetic brush is moved in the rotating direction of the developing sleeve, based on the rotation of said developing sleeve, i.e. in the direction opposite to the direction of transportation of the developing material. During the transportation, both parts of the developing material as described above are caused to stir each other and there is an exchanging of developing material therebetween. More specifically, as a result of the above agitation, the direction of movement of the developing material to be displaced in the direction opposite to the direction of transportation of the developing material is changed to the opposite direction, i.e. toward the developing region, and thus, part of the developing material equivalent in amount to the amount of the developing material the direction of movement of which has been changed (the above part of the developing material is the part being displaced in the direction of transportation referred to above) has its direction of movement reversed. In the magnetic brush developing device as described above and put into practical use at present, since the point of supply of developing material to the outer peripheral surface of the developing sleeve is spaced a comparatively long distance from the developing region, the distance of transportation of the developing material is sufficiently long to allow exchange between both parts of the developing material as described earlier at a considerable rate.

However, according to the experiments carried out by the present inventors, it has been found that the exchanging of the developing material as described above tends to give rise to lowering of toner concentration in the developing material at the developing region, with a consequent reduction of density of the copied images (i.e. developed image density). More specifically, in the developing region, toner is consumed during development of the electrostatic latent image, resulting in reduction of the toner concentration in the developing material, and part of the developing material with the lower toner concentration is moved in the direction opposite to the direction of transportation of the developing material on the whole, following rotation of the developing sleeve as described earlier so as to be exchanged with the developing material newly supplied onto the outer peripheral surface of the developing sleeve and coming into the developing region. As a result, toner concentration in the developing material being transported is substantially lowered, and thus, on the whole, developing material having a substantially lowered toner concentration as compared with the supplied developing material is transported to the developing region with a consequent reduction in the image density. The phenomenon as described above is especially noticeable when a so-called entirely black copy is made, i.e. when a solid electrostatic latent image is developed.

SUMMARY OF THE INVENTION

Accordingly, an essential object of the present invention is to provide an improved magnetic brush developing apparatus employing a developing sleeve and a magnetic roller driven for rotation, in which exchanging of developing material during transportation thereof from a developing material supply position to a developing region as described earlier is substantially prevented so as to eliminate reduction of toner concentration at the developing region due to such exchanging in order to obtain favorably developed images.

Another important object of the present invention is to provide a magnetic brush developing apparatus of the above described type which has a simple construction and functions accurately with high reliability, and can be readily incorporated into copying apparatuses and the like at low cost.

In accomplishing these and other objects, according to a magnetic brush develoing apparatus of the present invention, a developing material transport guide member extending from the developing material supply position to the developing region is provided in addition to the developing sleeve and magnetic roller, with a clearance being maintained between the guide member and the outer peripheral surface of the developing sleeve, so as to transport the developing material supplied at the developing material supply position, along the outer surface of the developing material transport guide member, up to the developing region by the rotation of the magnetic roller, while part of the developing material from the developing region is moved in the direction opposite to the direction of transportation of the supplied developing material through the clearance between the developing sleeve and the developing material transport guide member by the rotation of the developing sleeve, so that the undesirably exchanging between the fresh developing material and the developing material which has been used for the developing during the transportation is substantially prevented by the developing material transport guide member.

More specifically, according to one preferred embodiment of the present invention, there is provided a magnetic brush developing apparatus for use in an electrographic copying apparatus and the like, which includes a developing sleeve driven for rotation in a direction opposite to the transporting direction of a freshly supplied developing material, a magnetic roller rotatably disposed within the developing sleeve and driven for rotation in the same direction as the direction of rotation of the developing sleeve, a developing material transport guide member extending along said developing sleeve from a developing material supply position to the vicinity of a developing region, with a clearance being provided between the developing material transport guide member and the outer peripheral surface of the developing sleeve, means for supplying fresh developing material onto the outer surface of the developing material transport guide member located at the developing material supply position, and a cleaning means for removing from the outer peripheral surface of the developing sleeve the developing material moving from the developing region in the rotational direction of the developing sleeve on the outer peripheral surface of said developing sleeve. The developing material supplied at the developing material supply portion is transported over the outer surface of said developing material transport guide member to the developing region by the rotation of the magnetic roller, while part of the developing material located at the developing region moves in a direction opposite to the transporting direction through the clearance between the developing sleeve and the developing material transport guide member by the rotation of said developing sleeve so as to be removed from the outer peripheral surface of the developing sleeve by the cleaning means.

By the arrangement according to the present invention as described above, an improved magnetic brush developing apparatus which is capable of providing favorable developed images by elimination of reduction in toner concentration at the developing region has been advantageously provided.

BRIEF DESCRIPTION OF THE DRAWINGS

These and other objects and features of the present invention will become apparent from the following description of a preferred embodiment thereof with reference to the accompanying drawings, in which.

DETAILED DESCRIPTION OF THE INVENTION

Figure 1:
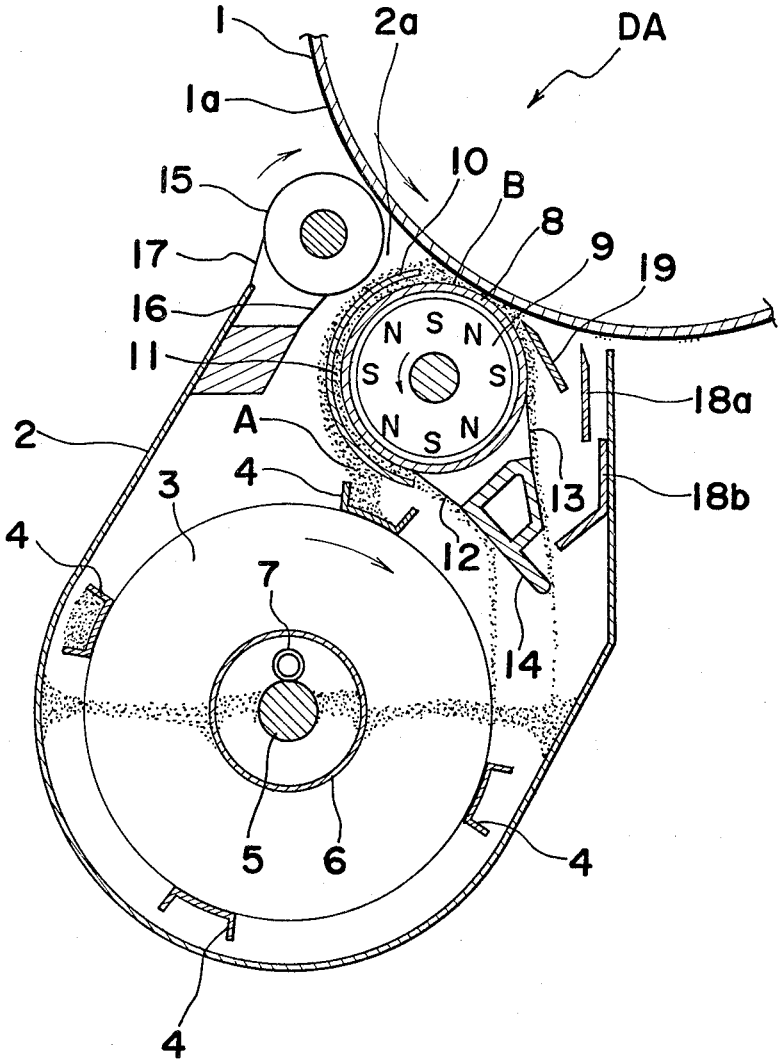
FIG. 1 is a schematic side sectional view of a magnetic brush developing apparatus according to one preferred embodiment of the present invention.

Before the description of the present invention proceeds, it is to be noted that like parts are designated by like reference numerals throughout the accompanying drawings.

Referring now to the drawings, there is shown in FIG. 1, a magnetic brush developing apparatus DA according to one preferred embodiment of the present invention. The developing apparatus DA generally includes a developing tank 2 extending the width of a photoreceptor drum 1 and substantially enclosed except for an opening 2*a* confronting a photosensitive or photoreceptor layer 1*a* formed on the peripheral surface of the drum 1 whereat the development of electrostatic latent images formed on the photoreceptor surface 1*a* is effected, an outer cylinder or developing sleeve 8 rotatably provided in the tank 2 adjacent to the photoreceptor surface 1*a*, a magnetic roller 9 rotatably enclosed in said developing sleeve 8, a bucket roller 3 also rotatably provided in the tank 2 in a position below and adjacent to the developing sleeve 8, a developing material transport guide plate 10 disposed along part of the peripheral surface of the developing sleeve 8, and a cleaning plate 12 contacting the lower portion of said developing sleeve 8.

The developing apparatus DA is incorporated in a so-called toner image transfer type electrophotographic copying machine (the remainder of which is not shown), and the photoreceptor drum 1 having the photoreceptor surface or layer 1*a* on the outer peripheral surface thereof is arranged to be driven for rotation at a circumferential speed of 300 mm/sec. in the counterclockwise direction as shown by an arrow in FIG. 1.

The bucket roller 3 has a plurality of troughs or buckets 4 provided at equal intervals in the circumferential direction around the peripheral surface thereof, and is arranged to be driven for rotation in the clockwise direction about a rotating shaft 5 so as to dip up a magnetic developing material accommodated in the developing tank 2 by the buckets 4 for transportation thereof up to a developing material supply position A.

The magnetic developing material is prepared by mixing through stirring small diameter carrier particles with electrically insulative toner particles at a ratio of 90% by weight of the carrier to 10% by weight of the toner, and the insulative toner particles are normally charged to a polarity opposite to that of the electrostatic latent images to be formed on the photoreceptor layer 1*a* of the photoreceptor drum 1. More specifically, the small diameter magnetic carrier particles are prepared by dispersing magnetic fine particles in a resin, and have an average particle diameter of 20 to 40 $\mu$m, and a resistance value of $10^{14}$ $\Omega$·cm, while the electrically insulative toner of non-magnetic nature has an average particle diameter in the range of 10 to 15 $\mu$m. The insulative toner as described above is fed by a toner dispensing device (not shown) into a cylinder 6 axially extending within the developing tank 2, and is stirred and transported in the axial direction in said cylinder 6 by rotation of a coil spring 7 wound around the rotary shaft 5, and is discharged into the developing tank 2 through an opening (not shown) in the cylinder 6.

The developing sleeve 8 is made of a cylinder of stainless steel material having a diameter of 31 mm, and is arranged to confront the photoreceptor surface 1*a* of the drum 1 through a developing gap in the range of 0.5 to 0.9 mm, and in this embodiment, of 0.7 mm at a developing region B for being driven for rotation at 50 to 60 r.p.m. and in this embodiment, at 60 r.p.m. in the counterclockwise direction.

Although a developing bias having the same polarity as that of the electrostatic latent image is normally impressed to the above developing sleeve 8, in the case where a reversal development is to be effected by the use of this developing apparatus, it is necessary to reverse both of the polarity of the electrostatic latent image and that of the developing bias to opposite polarities (It is to be noted here that the polarities for both of the electrostatic latent image and the developing bias are the same during the reversal development also).

On the other hand, the magnetic roller 9 magnetized with eight poles for N and S poles in alternately different polar orientation in the circumferential direction thereof and rotatably disposed within the developing sleeve 8, is driven for rotation in the counterclockwise direction at a speed of from 1800 to 2400 r.p.m. and in this embodiment, at 2200 r.p.m. The magnetic force of the magnetic roller 9 as described above is 1000 Gauss on the outer peripheral surface of the developing sleeve 8, and 500 Gauss on the outer peripheral surface of the developing material transport guide plate 10 to be described hereinbelow, so that the magnetic action of the magnetic roller 9 is sufficiently exerted on the magnetic developing material on the outer peripheral surface of the developing material transport guide plate 10.

The developing material transport guide plate 10 is a stainless steel plate having a thickness in the range of 0.5 to 1.5 mm and more preferably, of 0.5 to 1 mm, and in this embodiment, of 1 mm, and extends clock-wise from the developing material supply position A to the vicinity of the developing region B, with a clearance 11 of 1.0 to 1.5 mm, and in this embodiment 1.5 mm, being provided between said guide plate 10 and the outer peripheral surface of the developing sleeve 8. It is to be noted here that the developing material transport guide plate 10 as referred to above has an arcuate cross section concentric with the peripheral surface of the developing sleeve 8.

The cleaning plate 12 is a thin sheet of phosphor bronze or stainless steel having a thickness of 100 μm, and is mounted on a support member 14, at a position close to an edge of the guide plate 10 at the developing material supply position A, so that the forward edge of said cleaning plate 12 contacts the peripheral surface of the developing sleeve 8 under pressure in a direction opposite the direction of rotation of said developing sleeve 8. The support member 14 also has mounted thereon a scraper plate 13 held in pressure contact with the peripheral surface of the developing sleeve 8 in a position downstream of the developing region B. The scraper plate 13 is a thin sheet of phosphor bronze, stainless steel or polyester having a thickness in the range of 50 to 100 μm, and in this embodiment, of 50 μm, and is held in pressure contact with the developing sleeve 8 in a direction the same as the direction of rotation of said sleeve 8.

On the other hand, in the upper opening 2*a* of the developing tank 2, there are provided a dust discharge prevention roller 15 at the left side, and a dust discharge prevention plate 18*a*, a dust suppressing plate 18*b* and a developing material scattering prevention plate 19 made of a grounded electrically conductive metallic plate at the right side as shown in FIG. 1. It should be noted here that the developing material scattering prevention plate 19 referred to above is required to be impressed with a bias having a polarity opposite to the polarity of the developing bias, if it is intended to effect the reversal development by the use of the developing apparatus described so far.

The dust discharge prevention roller 15 made of resin or stainless steel is driven for rotation in the clockwise direction, and is supported by electrical insulation means, with a gap of 0.5 mm being maintained with respect to the surface 1*a* of the photoreceptor drum 1. Moreover, a cleaning plate 16 made of phosphor bronze or stainless steel and a seal plate 17 formed by a polyester film respectively have the forward edges thereof held in pressure contact with the peripheral surface of the dust discharge prevention roller 15 in directions opposite to and the same as the direction of rotation of said roller 15. The cleaning plate 16 is intended to remove the developing material adhering to the peripheral surface of the roller 15, while the dust suppressing plate 18*b* has for its object to prevent the dust of the developing material produced at the inner lower portion of the developing tank 2, from floating upwardly towards the opening 2*a* of the developing tank 2.

By the above arrangement, the developing sleeve 8 and the magnetic roller 9 are respectively driven for rotation in the counter clockwise direction at speeds of 60 r.p.m. and 2200 r.p.m., while the fresh developing material fed to the supply position A by the bucket roller 3 is transported over the peripheral surface of the developing material transport guide plate 10 in the clockwise direction, to the developing region B by the magnetic action of the rotation of the magnetic roller 9, and, while passing through said developing region B, develops the electrostatic latent image preliminarily formed on the surface of the photoreceptor drum 1. The used developing material after completion of the development as described above is transported along the peripheral surface of the development sleeve 8 in the clockwise direction, and is subsequently removed from the peripheral surface of the developing sleeve 8 by the scraper plate 13 so as to be returned to the developing material accommodated in the development tank 2. On the other hand, part of the used developing material located at the developing region B and more specifically, the developing material in the vicinity of root portions of the magnetic brush is moved in the counterclockwise direction through the clearance 11 between the developing sleeve 8 and the developing material transport guide plate 10 so as to be removed from the peripheral surface of the developing sleeve 8 by the cleaning plate 12 for return to the developing material within the developing tank 2. In the above state, it is important that at the edge portion of the developing material transport guide plate 10 at the developing material supply position A, the used developing material not be directed onto the outer peripheral surface of the developing material transport guide plate 10, because if the used developing material should advance onto the peripheral surface of the guide plate 10 as described above, the toner concentration of the fresh developing material in the developing region B may possibly be lowered. For preventing the undesirable advance of the used developing material as stated above, the clearance 11 can be enlarged or broadened at said edge portion of the developing material transport guide plate 10.

In the above case, part of the developing material moving through the clearance 11 in the direction opposite to the direction of transportation of the fresh developing material by the rotation of the sleeve 8, has a low toner concentration, but is advantageously separated or partitioned from fresh developing material newly transported into the developing region B and having a high toner concentration by the developing material transport guide plate 10 which acts as a wall-like obstacle, and therefore, there is no possibility that the two developing materials as described above will have portions thereof exchanged as in the conventional apparatus, and no reduction of toner concentration in the developing material at the developing region B will occur. It should also be noted here that, since the developing material passing through the clearance 11 is moved in the same direction as that of rotation of the developing sleeve 8, no force is physically applied to compress the developing material, so that the movement of the developing material is consequently smoothly effected.

The speed, amount, etc. for transporting the developing material according to the present embodiment will be described hereinbelow.

The speed Vf of transportation, and the amount of developing material transported on the outer peripheral surface of the developing material transport guide plate 10 are respectively set to be 12 cm/sec. and 360 mg/sec.cm. After passing the developing region B, the transportation speed Vt and the amount of the developing material transported are at 3 to 4 cm/sec., and 100 mg/sec.cm respectively. Meanwhile, the amount and the speed Vb of movement of the developing material moved through the clearance 11 are respectively 260 mg/sec.cm and 4.3 cm/sec.

Figure 2:
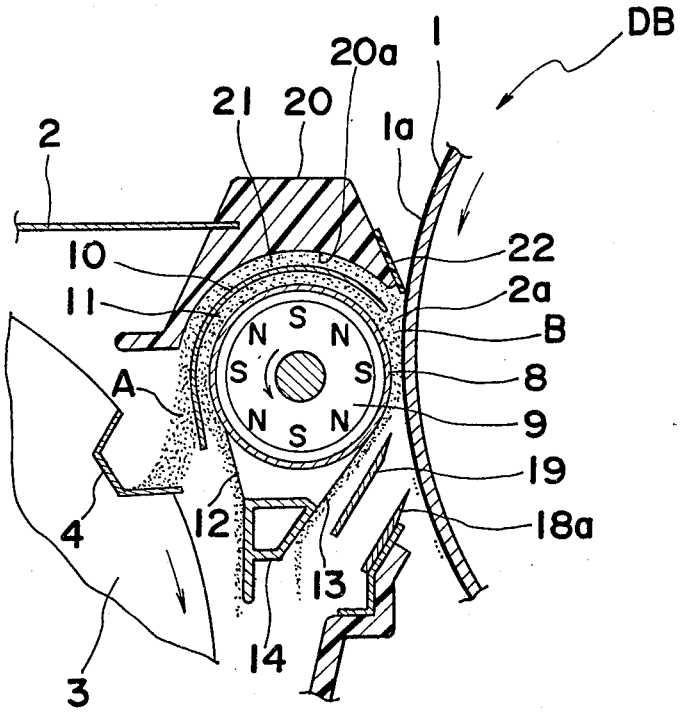
FIG. 2 is a fragmentary side sectional view showing a main portion of a magnetic brush developing apparatus according to a modification of the present invention.

Referring further to FIG. 2, there is shown a modification of the magnetic brush developing apparatus DA of FIG. 1. In the modified magnetic brush developing apparatus DB in FIG. 2, the dust discharge prevention roller 15 and the cleaning plate 12 and seal plate 17 described as employed in the arrangement of FIG. 1 have been replaced by an upper casing 20 formed of a resin material and provided above the developing material transport guide plate 10 in the opening 2*a* of the developing tank 2 and a seal plate 22 of polyurethane provided at one edge face of said upper casing 20. Between an arcuate inner peripheral surface 20*a* of the casing 20 and the corresponding outer peripheral surface of the guide plate 10 is provided a clearance 21 in the range of 1 to 1.5 mm and in this modification, at 1.5 mm, while the seal plate 22 is located on an extension of the arc of the inner peripheral surface 20*a* of the upper casing 20. Since the remainder of the construction and the movement of the developing material in the modified developing apparatus DB of FIG. 2 are generally similar to those of the embodiment of FIG. 1, a detailed description thereof is omitted here for brevity.

In the modified developing apparatus DB of FIG. 2, the upper casing 20 functions as a dust prevention plate for the developing material, and the arcuate inner peripheral surface 20*a* of said upper casing 20 is rubbed by the developing material transported in the clockwise direction through the clearance 21, i.e. over the outer peripheral surface of the developing material transport guide plate 10 described earlier. Meanwhile, the seal plate 22 functions to prevent discharge of the developing material and to prevent the developing material in a cloud-like state from contacting the surface 1*a* of the photoreceptor drum 1 which is not to be subjected to development as yet.

It should be noted here that excessive reduction of the clearance 11, through which part of the developing material after having been used for the development, is moved in the counter clockwise direction as described earlier, is not preferable, since if it becomes too narrow, the amount of the developing material moved is decreased and a pool or collection of developing material greater than necessary forms at the upper portion of the developing region B, thus resulting in an undue stress. Furthermore, it is undesirable that the developing material be supplied onto the outer peripheral surface of the developing sleeve 8 at the developing material supply position A, and for the prevention of supply of the developing material as described above, it is desirable that the end portion of the developing material transport guide plate 10 at the developing material supply position A should be extended in the counterclockwise direction past the developing material supply position A. It is also to be noted, however, that the supply of the developing material as described above need not necessarily be eliminated completely, but may be present to a certain extent, if such supply of the developing material is within a range which will not give rise to any inconvenience.

It has already been confirmed through experiments carried out by the present inventors that in the two embodiments of the present invention described so far, even when so-called solid black copies are made, reduction in the copied image density (i.e. developed image density) does not take place.

More specifically, when the experiments were carried out by continuously forming solid black electrostatic latent images each having an area of 50×50 mm on the surface 1*a* of the photoreceptor drum 1 at intervals of 10 mm in the direction of rotation of said photoreceptor drum 1, with subsequent continuous developments of these electrostatic latent images, the electrostatic latent images developed as black solid images had a uniform density of approximately 1.30. On the other hand, when experiments were carried out with the developing material transport guide plate 10 removed from the developing apparatuses of the embodiments, it was found that the first electrostatic latent image developed was a black solid image in which the density gradually decreased from 1.30 towards 0.8 in the rotational direction of the photoreceptor drum 1, while the second and subsequent electrostatic latent images developed had a low density of approximately 0.8.

As is clear from the foregoing description, according to the magnetic brush developing apparatus of the present invention, since the developing material transport guide plate is provided which extends from the developing material supply position to the developing region, with a clearance being provided with respect to the outer peripheral surface of the developing sleeve so as to transport the fresh developing material supplied at the developing material supply position over the outer surface of said developing material transport guide plate to the developing region, by the rotation of the magnetic roller, while part of the used developing material from the developing region moves through the clearance between the developing sleeve and the developing material transport guide plate in the direction opposite to said direction of transportation by the rotation of the developing sleeve, the fresh developing material transported to the developing region by the rotation of the magnetic roller is separated or partitioned by the developing material transport guide plate from the part of the used developing material having a low toner concentration after having been used for the development and moving in the direction opposite to the above direction of transportation by the rotation of the developing sleeve, and therefore, the undesirable exchange between the developing materials respectively moving in the opposite directions to each other is almost completely prevented so that developed images of favorable qualities are provided by elimination of reduction in the toner concentration at the developing region.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A magnetic brush developing apparatus for use in an electrographic copying apparatus and the like having a developing region and employing a developing material having magnetic carrier particles and electrically insulative toner particles, which apparatus comprises:

a developing sleeve having the surface thereof adjacent the developing region and driven for rotation in one direction;

a magnetic roller rotatably disposed within said developing sleeve and driven for rotation in said one direction;

means, located at a developing material supply position spaced from said developing region, for supplying fresh developing material;

a developing material transport guide member spaced from said developing sleeve and extending from said developing material supply position to the vicinity of said developing region, with a clearance between said developing material transport guide member and the outer peripheral surface of said developing sleeve;

means for driving said magnetic roller at a speed sufficiently greater than the speed of said developing sleeve for causing fresh developing material supplied at said developing material supply position to be transported over the outer surface of said developing material transport guide member in the direction opposite to said one direction to said developing region by the rotation of said magnetic roller and to cause part of the used developing material to move from said developing region through said clearance in said one direction by the rotation of said developing sleeve; and cleaning means for removing from the outer peripheral surface of said developing sleeve developing material moving through said clearance from the developing region.

2. A magnetic brush developing apparatus as claimed in claim 1 wherein the speeds of said developing sleeve and magnetic roller and the size of said clearance are such that the amount of developing material transported per unit time over the outer surface of said developing material transport guide member to said developing region is larger than the amount of developing material transported per unit time through said developing region.

3. A magnetic brush developing apparatus as claimed in claim 1 further comprising a scraper means spaced around said developing sleeve in a direction opposite to said one direction of rotation from said developing region for removing the developing material transported through said developing region from the outer peripheral surface of said developing sleeve.

4. A magnetic brush developing apparatus as claimed in claim 1 wherein said developing material transport guide member is a plate of non-magnetic material having an arcuate cross section concentric with the outer peripheral surface of said developing sleeve.

5. A magnetic brush developing apparatus as claimed in claim 1 wherein said developing material supply position is located adjacent the periphery of said developing sleeve, said developing material transport guide member extends around and is spaced from that portion of the outer peripheral surface of said developing sleeve which is moving in said one direction from said developing region to said developing material supply position, to thereby define said clearance, said part of said used developing material moves through said clearance toward said developing material supply position, and said cleaning means is positioned adjacent the end of said developing material transport guide member which is adjacent said developing material supply position.

* * * * *